US006941868B2

(12) United States Patent
Herget

(10) Patent No.: US 6,941,868 B2
(45) Date of Patent: Sep. 13, 2005

(54) SINGLE INCREMENT INITIATOR CHARGE

(75) Inventor: John Herget, Liberty, UT (US)

(73) Assignee: Autoliv ASP, Inc., Ogden, UT (US)

( * ) Notice: Subject to any disclaimer, the term of this patent is extended or adjusted under 35 U.S.C. 154(b) by 103 days.

(21) Appl. No.: 10/607,231

(22) Filed: Jun. 26, 2003

(65) Prior Publication Data

US 2005/0011598 A1 Jan. 20, 2005

(51) Int. Cl.[7] ..... C06C 9/00; C06B 33/12
(52) U.S. Cl. ..... 102/205; 149/40; 149/108.6
(58) Field of Search ..... 149/45, 38, 40, 149/42, 43, 44, 108.6, 77; 102/205

(56) References Cited

U.S. PATENT DOCUMENTS

| | | | | |
|---|---|---|---|---|
| 3,203,843 A | | 8/1965 | Jackson | |
| 4,858,951 A | | 8/1989 | Lenzen | |
| 5,403,036 A | | 4/1995 | Zakula et al. | |
| 5,531,473 A | | 7/1996 | Rink et al. | |
| 5,556,132 A | | 9/1996 | Sampson | |
| 5,672,843 A | | 9/1997 | Evans et al. | |
| 5,686,691 A | | 11/1997 | Hamilton et al. | |
| 5,993,578 A | * | 11/1999 | Timmerman | 149/109.6 |
| 6,077,372 A | | 6/2000 | Mendenhall et al. | |
| 6,117,254 A | | 9/2000 | Rink | |
| 6,224,099 B1 | * | 5/2001 | Nielson et al. | 280/741 |

* cited by examiner

*Primary Examiner*—Aileen Felton
(74) *Attorney, Agent, or Firm*—Sally J. Brown

(57) ABSTRACT

A single increment initiator charge for use in an inflatable restraint system and a method of preparing the single increment initiator charge are provided. The single increment initiator charge includes a homogeneous blend of zirconium, an oxidizer such as potassium perchlorate, and a combustion enhancer such as titanium hydride in an amount effective to result in the single increment initiator charge being effective to ignite an associated pyrotechnic charge. The single increment initiator charge may be formed by preparing a homogeneous blend such as by dry-blending the constituents or by mixing the constituents with a solvent such as an alcohol to form a slurry, loading the homogeneous blend into a charge holder and compressing the homogeneous blend.

41 Claims, 1 Drawing Sheet

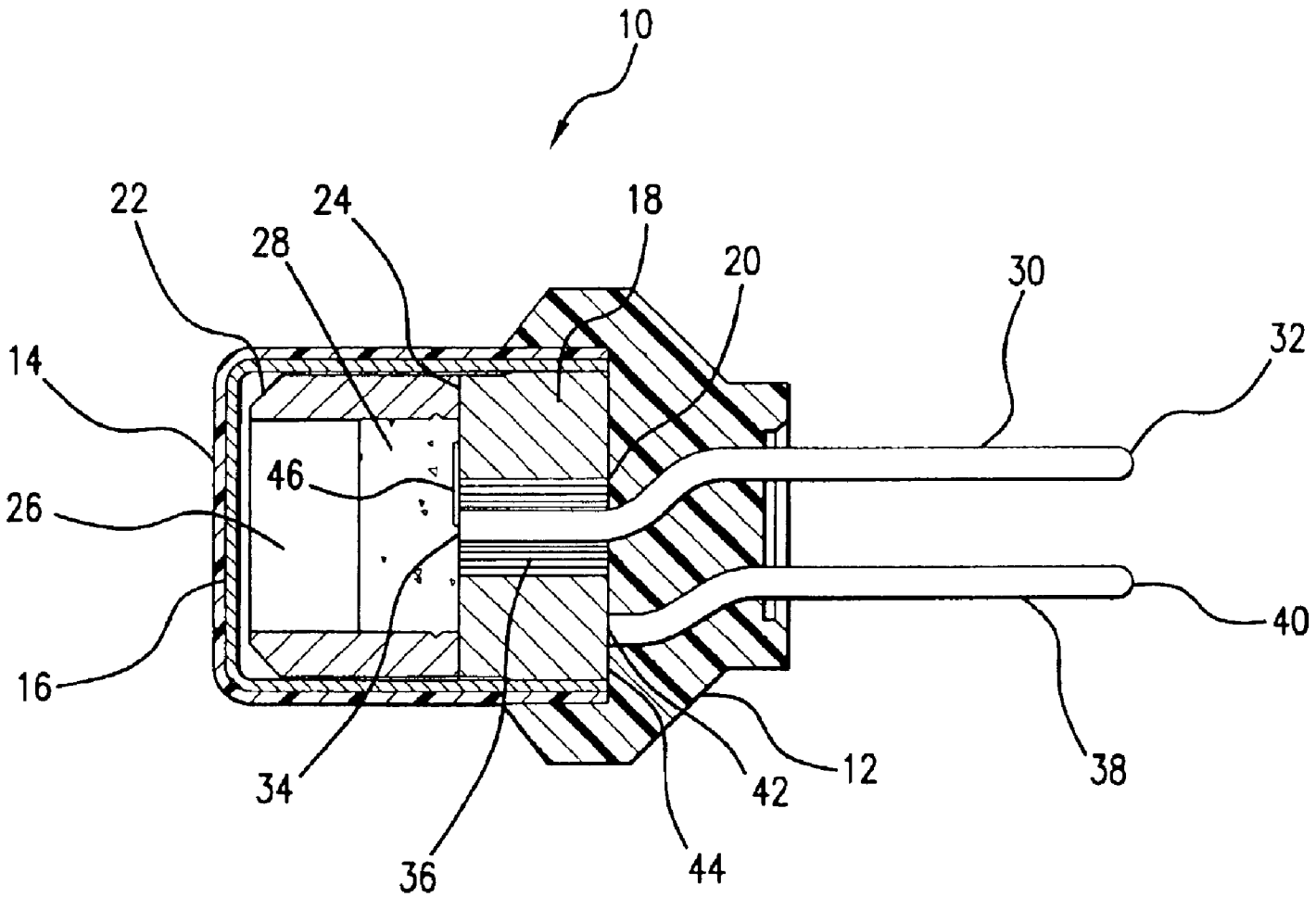
10
18
20
22
24
28
30
32
34
36
38
40
42
44
46
14
16
26
12

SINGLE INCREMENT INITIATOR CHARGE

BACKGROUND OF THE INVENTION

This invention relates generally to an initiator charge for use in an igniter assembly of an inflator device for an inflatable restraint system. More particularly, the invention relates to a single increment initiator charge effective to ignite an associated pyrotechnic composition.

It is well known to protect a vehicle occupant using a cushion or bag, e.g., an "airbag cushion" that is inflated or expanded with a gas when a vehicle experiences a sudden deceleration, such as in the event of a collision. Such airbag restraint systems normally include: one or more airbag cushions, housed in an uninflated and folded condition to minimize space requirements; one or more crash sensors mounted on or to the frame or body of the vehicle to detect sudden deceleration of the vehicle; an activation system electronically triggered by the crash sensors; and an inflator device that produced or supplies a gas to inflate the airbag cushion. In the event of a sudden deceleration of the vehicle, the crash sensors trigger the activation system which in turn triggers the inflator device which begins to inflate the airbag cushion in a matter of milliseconds.

Many types of inflator devices have been disclosed in the art for inflating one or more inflatable restraint system airbag cushions. Such inflator devices typically include: an igniter assembly; multiple combustible pyrotechnic compositions; and a housing for containing the igniter assembly and the one or more pyrotechnic compositions. The igniter assembly generally includes an eyelet having one or more electrically conductive pins connected to a bridgewire to form a closed electrical circuit. The bridgewire is maintained in intimate contact with an electrically ignitable initiator charge that is held or contained within a charge holder or cup. In the event of a collision, the activation system directs an electrical current through the conductive pins of the igniter assembly to the bridgewire. The bridgewire ignites the initiator charge which in turn ignites an associated pyrotechnic composition such as an igniter composition or a gas generant composition to begin production of inflation gas and, thereby, inflation of an associated or corresponding airbag cushion.

Various initiator charges have been disclosed in the art for igniting an associated pyrotechnic composition. Typically, in order to meet industry and federal safety standards, such initiator charges include two separate compositions or increments: an igniter composition or increment that is generally electrothermally conductive and ignitable; and an enhancer or booster composition or increment that increases the temperature of combustion and pressure output of the igniter assembly. Generally, such compositions are loaded sequentially into the charge holder with the igniter composition or increment placed in intimate contact with the bridgewire to facilitate firing of the inflator device.

A number of igniter compositions or increments have been disclosed in the art for use in inflator devices such as are used in inflatable restraint systems. One such igniter composition or increment includes a metal or metal fuel such as zirconium or titanium and an oxidizer such as potassium perchlorate. Such igniter compositions are particularly desired because they generally readily ignite upon the application of an electrical current. However, for automotive applications, such as in an inflatable restraint system, such igniter compositions or increments typically do not generate sufficient heat and/or pressure to ignite an associated pyrotechnic composition. Thus, such igniter compositions or increments are generally used in combination with a separately compounded enhancer or booster composition or increment.

The enhancer or booster composition or increment generally serves to increase the temperature of combustion and/or to increase the pressure generated during the combustion of the initiator charge. Suitable enhancer or booster compositions or increments may typically include metal hydrides such as titanium hydride or zirconium hydride in combination with an oxidizer compound such as potassium perchlorate. Generally, such enhancer or booster compositions or increments do not possess sufficient electrothermoconductive properties to adequately ignite when exposed to an electrical current passed through an associated bridgewire. Thus, such enhancer or booster compositions or increments are typically used to supplement the igniter composition or increment.

The sequential loading of two separate compositions or increments requires additional process steps such as separate compounding, loading and compression steps to form an initiator charge effective to ignite an associated pyrotechnic composition. Such additional steps generate increased manufacturing expenses such as in the form of added equipment, labor, quality assurance analysis and process time. Moreover, the materials typically employed in both the igniter composition or increment and the enhancer or booster composition or increment can be difficult or dangerous to load and can pose significant safety concerns for those handling such materials. Thus, compounding and loading two separate compositions or increments increases the level of risk to which workers are exposed.

In view of the above, there is a need and a demand for a single increment initiator charge that meets the requirements for a multiple increment initiator charge. In particular, there is a need and a demand for a single increment initiator charge that is effective to reproducibly and reliably ignite an associated pyrotechnic composition. There is a further need and a demand for a single increment initiator charge that is more cost-effective and safer to manufacture than commercially available initiator charges including multiple, sequentially loaded compositions or increments.

SUMMARY OF THE INVENTION

A general object of the invention is to provide an improved initiator charge and a method of preparing such an initiator charge for use in an inflator device of an inflatable restraint system.

A more specific objective of the invention is to overcome one or more of the problems described above.

The general object of the invention can be attained, at least in part, through a single increment initiator charge including a homogeneous blend of zirconium, an oxidizer and a combustion enhancer in an amount effective to result in the single increment initiator charge being effective to ignite an associated pyrotechnic charge. In accordance with certain preferred embodiments, the homogeneous blend includes at least about 20 composition weight percent zirconium.

The prior art generally fails to provide a single increment initiator charge including an effective amount of a combustion enhancer and method of preparation of such a single increment initiator charge that is as effective as desired in satisfying one or more of the above-identified performance or manufacturing criteria. Further, the prior art has generally failed to provide a single increment initiator charge and associated method production related to utilizing a homogeneous blend of zirconium and an oxidizer having increased electrothermal sensitivity.

The invention further comprehends a method for making a single increment initiator charge for use in an inflator device for an inflatable restraint system wherein a homogeneous blend of zirconium, an oxidizer, and an effective amount of a combustion enhancer is prepared, loaded into a charge holder, and compressed. In accordance with one preferred embodiment, the method further includes the step of dry blending the zirconium, the oxidizer and the combustion enhancer to form the homogeneous blend. In accordance with another preferred embodiment of the invention, the method includes the step of mixing the zirconium, the oxidizer, and the combustion enhancer with a solvent to form the homogeneous blend.

The invention still further comprehends a single increment initiator charge prepared by a process including: forming a homogeneous blend of zirconium, an oxidizer, and a combustion enhancer in an amount effective to result in the single increment initiator composition being effective ignite an associated pyrotechnic composition; loading the homogeneous blend into a charge holder; and compressing the homogeneous blend to form the single increment initiator charge. In accordance with certain preferred embodiments, the homogeneous blend includes:

about 20 to about 60 composition weight percent zirconium;

about 30 to about 75 composition weight percent oxidizer; and about 10 to about 40 composition weight percent combustion enhancer.

In other preferred embodiments of the invention, the combustion enhancer includes a metallic combustion enhancer, an organic combustion enhancer, or a combination thereof.

Reference herein to the term "increment" is to be understood to refer to a mixture or composition that is individually compounded. Reference to multiple increments is to be understood to refer to two or more separately compounded and loaded mixtures or compositions which may include different constituents or the same constituents in the same or different amounts.

Reference herein to the term "homogeneous blend" is to be understood to refer to a material consisting of a uniform mixture wherein each individual component, constituent or ingredient is evenly distributed throughout the whole.

Reference herein to the term "pyrotechnic composition" is to be understood to refer to a material or chemical composition that rapidly combusts or decomposes to release light, heat and/or gas.

Reference herein to the "All Fire (AF)" standard is to be understood to refer to a material that will ignite 99.9999% of the time with a 95% confidence level with no greater than 1.2 amperes direct current applied for 2 milliseconds at −40 C to +23 C. The AF rating for a particular initiator charge may be determined according to the Bruceton Method as disclosed in U.S. Military Standard (MIL-STD) 331B, Test D2 (Projectile Fuze Arming Distance).

Reference herein the "No Fire (NF)" standard is to be understood to refer to a material that will not ignite 99.9999% of the time with a 95% confidence level with a maximum direct current of 400 milliamperes applied for 10 seconds at +23 C to +85 C. The NF rating of a particular initiator charge may be determined according to the Bruceton Method as disclosed in U.S. Military Standard (MIL-STD) 331B, Test D2 (Projectile Fuze Arming Distance).

Reference herein to the "Time to First Light (TTFL)" standard is to be understood to refer to the time interval as measured from the onset of a demand-to-fire signal, e.g., application of a direct current during an All Fire test as disclosed above, until the first observed emission of optical energy. The TTFL rating for a particular initiator charge should not exceed 2 milliseconds.

Reference herein to the "Electrostatic Discharge Sensitivity (ESD)" standard is to be understood to refer to a material that will not degrade and will not deploy when subjected to the following capacitive discharge test, e.g., a 500-picofarad capacitor (+/−10%) is charged to 25,000 volts (+/−250V) and then discharged through a 5000 olm-resistor (+/−10%), connected in series to an igniter assembly, or, more preferably, a 150-picofarad capacitor (+/−10%) is charged to 25,000 volts (+/−250V) and then discharge through a 150 ohm-resistor (+/−10%), connected in series to an igniter assembly. The subject igniter assembly is subjected to 5 discharges with a minimum of 5 seconds between discharges as per U.S. Military Standard (MIL-STD) 1576, Method 2205, via each of the following connections: (1) first conductive pin to second conductive pin; (2) first conductive pin to eyelet; (3) second conductive pin to eyelet; and (4) shorted conductive pins.

Other objects and advantages will be apparent to those skilled in the art from the following detailed description taken in conjunction with the appended claims and drawing.

BRIEF DESCRIPTION OF THE DRAWING

The FIGURE is a cross-sectional view of an igniter assembly including a single increment initiator charge of the invention.

DETAILED DESCRIPTION OF THE INVENTION

The present invention provides a single increment initiator charge such as for use in an igniter assembly of an inflator device for an inflatable restraint system. Such single increment initiator charge typically includes a homogeneous blend of zirconium, an oxidizer, and a combustion enhancer in an amount effective to result in the single increment initiator charge being effective to ignite an associated pyrotechnic charge.

As will be appreciated, the present invention may be embodied in a variety of different structures. Referring to the FIGURE, there is illustrated an igniter assembly, generally designated by reference numeral 10. The igniter assembly 10 includes a housing 12 that connects three main components of the igniter assembly, namely, a cover member 14, a cup 16 and an eyelet 18 having a bore 20 therethrough. The eyelet 18 has a charge holder 22 affixed to an upper surface 24. The charge holder 22 defines an inner cavity 26 which contains an initiator charge 28. The igniter assembly further includes a first conductive pin 30 having an outer connection end 32 and an opposed inner terminal end 34 positioned within bore 20 and held in place by a glass insulator or seal 36. The igniter assembly may also include a second conductive pin 38 having an outer connection end 40 and an opposed inner terminal end 42 which abuts a lower surface 44 of the eyelet 18 and is welded in place. A bridgewire 46 in the inner cavity 26 of the charge holder 22 connects the inner terminal end 34 of the first conductive pin 30 and to the upper surface 24 of the eyelet 18. This provides an electrical circuit which includes the bridgewire 46, the eyelet 18, the first conductive pin 30, and the second conductive pin 38. Suitably, the initiator charge 28 is positioned within the inner cavity 26 of the charge holder 22 in intimate contact with the bridgewire 46 such that when an electrical current is applied to the first and second conductive pins, 30 and 38, respectively, such as in the event of a sudden deceleration of a vehicle, the bridgewire 46 is heated and thereby ignites the initiator charge 28.

It is generally desirable in the production of igniter assemblies and associated initiator charges to minimize costs, labor and safety risks associated with handling the chemical compounds that make up the initiator charges. However, as described above, prior art igniter assemblies typically include at least two separately compounded and sequentially loaded compositions or increments: an igniter composition or increment positioned in intimate contact with a thermotransducer such as a bridgewire; and an enhancer composition or increment positioned in intimate contact with the igniter increment. In general, the igniter composition or increment does not have a sufficient combustion temperature or gas output to function alone to ignite an associated pyrotechnic composition and, thus, is typically used in combination with a combustion enhancer. Heretofore, the inclusion of a combustion enhancer within the igniter composition or increment to form a single increment initiator charge has generally been unknown. Previously, it was believed that the inclusion of such a combustion enhancer results in an igniter composition or increment having a decreased level of electrothermal sensitivity and, thus, a less effective and less reliable initiator charge. Typically, this loss of sensitivity was generally attributed to a reduction in the amount of metal or metal fuel and/or oxidizer included in the igniter composition or increment due to the addition of the combustion enhancer. However, it has been discovered that forming a homogeneous blend of a metal or metal fuel such as zirconium or titanium and an oxidizer such as potassium perchlorate results in an igniter composition or increment having an increased level of sensitivity to electrothermal stimuli over a comparable non-homogeneously compounded igniter composition or increment. In some instances, homogeneous blending of the metal or metal fuel and the oxidizer results in an igniter composition or increment having an electrothermal sensitivity that exceeds industry and federal safety standards. Thus, it has been discovered that a combustion enhancer may be added to a homogeneous blend of a metal or metal fuel and an oxidizer to result in a single increment initiator charge having a level of electrothermal sensitivity that is at least equivalent to that of a multiple increment initiator charge.

In accordance with the invention, a single increment initiator charge includes a combustion enhancer in an amount effective to result in the single increment initiator charge being effective to ignite an associated pyrotechnic composition. In particular, the single increment initiator charge includes a homogeneous blend of zirconium, an oxidizer and a combustion enhancer in an amount effective to result in the single increment initiator charge being effective to ignite an associate pyrotechnic composition. As used herein the term "effective to ignite an associated pyrotechnic composition" refers to an initiator charge that fulfills industry and federal standards for effective and reliable ignition of an associated igniter composition or gas generant composition within an inflator device for use in an inflatable restraint system. Such standards include the All Fire (AF), the No Fire (NF), the Time to First Ignition (TTFL), and the Electrostatic Discharge Sensitivity (ESD) standards as defined above.

Generally, the homogeneous blend of the single increment initiator charge may include at least about 20 composition weight percent of zirconium, desirably at least about 25 composition weight percent of zirconium, and, in certain preferred embodiments, at least about 30 composition weight percent of zirconium. Typically, the zirconium content of the single increment initiator charge is maintained at a concentration effective to provide a sufficient level of sensitivity to electrothermal stimuli to result in efficient and effective ignition of the single increment initiator charge. Thus, in certain aspects of the invention, the homogeneous blend may include about 20 to about 60 composition weight percent of zirconium.

In general, the homogeneous blend of the single increment initiator charge includes an oxidizer in an amount of at least about 30 composition weight percent, and, more particularly, in an amount of about 30 to about 75 composition weight percent. While various oxidizers may be used in the homogeneous blend of the single increment initiator charges of the invention, examples of suitable oxidizers include, but are not limited to, potassium perchlorate, potassium chlorate, aluminum oxide, magnesium nitrate, magnesium perchlorate, and combinations thereof. In accordance with certain preferred embodiments of the invention, the oxidizer may include potassium perchlorate.

Typically, the homogeneous blend of the single increment initiator charge of the invention includes a combustion enhancer in an amount effective to ignite an associated pyrotechnic composition such as in an amount of at least about 10 composition weight percent, and, more particularly, in an amount of about 10 to about 40 composition weight percent combustion enhancer.

Useful combustion enhancers that may be included in the homogeneous blend include metallic combustion enhancers, organic combustion enhancers, and combinations thereof. Examples of suitable metallic combustion enhancers include, but are not limited to, titanium hydride, aluminum, aluminum hydrides, copper, copper oxides, magnesium, magnesium hydrides, titanium, zirconium hydride, beryllium, and combinations thereof. A suitable organic combustion enhancer includes guanidine nitrate. In practice, the homogeneous blend of the single increment initiator charge may include a metal combustion enhancer such as titanium hydride.

In accordance with certain preferred embodiments of the invention, the homogeneous blend of the single increment initiator charge may include about 25 to about 35 composition weight percent of zirconium, about 50 to about 60 composition weight percent of potassium perchlorate oxidizer, and about 10 to about 25 composition weight percent of titanium hydride combustion enhancer.

In another aspect of the invention, a single increment initiator charge for use in an inflator device for an inflatable restraint system may be made by: preparing a homogeneous blend of zirconium, an oxidizer, and a combustion enhancer in an amount effective to result in the single increment initiator charge being effective to ignite an associated pyrotechnic composition; loading the homogeneous blend into a charge holder; and compressing the homogeneous blend to form a single increment initiator charge.

In accordance with certain preferred embodiments, the zirconium, the oxidizer and the combustion enhancer may be dry-blended to form the homogeneous blend.

In accordance with other preferred embodiments, the zirconium, the oxidizer and the combustion enhancer may be mixed with a solvent to form the homogeneous blend typically in the form of a slurry. Suitably, the solvent is an alcohol such as isopropyl alcohol, n-propyl alcohol, or a combination thereof. In practice, the mixture of the zirconium, the oxidizer, the combustion enhancer, and the solvent may be centrifuged prior to loading into the charge holder to remove air entrained during mixing of the components. Advantageously, the homogeneous blend in the form of a slurry is dried to remove the solvent prior to compression.

In certain preferred embodiments, it may be desirable to compress the homogeneous blend to a dry density of about 50 to about 95 percent of theoretical density.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

The following single increment initiator charges were prepared by weighing the components, combining them with a solvent and mixing the components with the solvent to form a homogeneous blend in the form of a solvent-based slurry. The resulting solvent-based slurries were centrifuged to remove air entrained during the mixing process and were loaded into charge holders. The slurries were dried to remove the solvent and form dried homogeneous blends which were compressed to form single increment initiator charges of the invention.

| Component | Example 1 | Example 2 |
|---|---|---|
| Zirconium | 32.86 | 27.50 |
| Potassium perchlorate | 53.23 | 57.50 |
| Titanium hydride | 13.91 | 15.00 |
| Total | 100.00 | 100.00 |

The initiator charges of the above Examples were analyzed and found to have a level of sensitivity to electrothermal stimuli comparable to an igniter increment including 55 composition weight percent zirconium and 45 composition weight percent potassium perchlorate. The initiator charges of the above Examples also passed the industry and federal standards for All Fire, No Fire, Time to First Light, and Electrostatic Discharge Sensitivity as defined above.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A single increment initiator charge comprising:

a homogeneous blend including:

zirconium;

an oxidizer; and a combustion enhancer, wherein the combustion enhancer is present in the homogeneous blend in an amount effective to result in the single increment initiator charge being effective to ignite an associated pyrotechnic composition.

2. The single increment initiator charge of claim 1 wherein the homogeneous blend includes at least about 20 composition weight percent of zirconium.

3. The single increment initiator charge of claim 1 wherein the homogeneous blend includes at least about 25 composition weight percent of zirconium.

4. The single increment initiator charge of claim 1 wherein the homogeneous blend includes at least about 30 composition weight percent of zirconium.

5. The single increment initiator charge of claim 1 wherein the oxidizer is selected from the group consisting of potassium perchlorate, potassium chlorate, potassium nitrate, aluminum oxide, magnesium nitrate, magnesium perchlorate, and combinations thereof.

6. The single increment initiator charge of claim 1 wherein the oxidizer comprises potassium perchlorate.

7. The single increment initiator charge of claim 1 wherein the homogeneous blend includes at least about 30 composition weight percent of an oxidizer.

8. The single increment initiator charge of claim 1 wherein the combustion enhancer is selected from the group consisting of metallic combustion enhancers, organic combustion enhancers, and combinations thereof.

9. The single increment initiator charge of claim 1 wherein the combustion enhancer comprises a metallic combustion enhancer selected from the group consisting of titanium hydride, aluminum, aluminum hydrides, copper, copper oxides, magnesium, magnesium hydrides, titanium, zirconium hydride, beryllium, and combinations thereof.

10. The single increment initiator charge of claim 1 wherein the combustion enhancer comprises an organic combustion enhancer including guanidine nitrate.

11. The single increment initiator charge of claim 1 wherein the combustion enhancer comprises titanium hydride.

12. The single increment initiator charge of claim 1 wherein the homogeneous blend includes at least about 10 composition weight percent of combustion enhancer.

13. The single increment initiator charge of claim 1 wherein the homogeneous blend includes:

about 20 to about 60 composition weight percent of zirconium;

about 30 to about 75 composition weight percent of oxidizer; and about 10 to about 40 composition weight percent of combustion enhancer.

14. The single increment initiator charge of claim 12 wherein the homogeneous blend includes:

potassium perchlorate oxidizer and titanium hydride combustion enhancer.

15. A single increment initiator charge prepared by a process comprising:

forming a homogeneous blend including:

zirconium;

an oxidizer; and a combustion enhancer in an amount effective to result in a single increment initiator charge being effective to ignite an associated pyrotechnic charge;

loading the homogeneous blend into a charge holder; and compressing the homogeneous blend to form the single increment initiator charge.

16. The single increment initiator charge of claim 15 wherein the zirconium, the oxidizer, and the combustion enhancer are dry-blended to form the homogeneous blend.

17. The single increment initiator charge of claim 15 wherein the zirconium, the oxidizer, and the combustion enhancer are mixed with a solvent to form the homogeneous blend.

18. The single increment initiator charge of claim 17 wherein the solvent comprises an alcohol selected from the group consisting of isopropyl alcohol, n-propyl alcohol, and combinations thereof.

19. The single increment initiator charge of claim 17 wherein the homogeneous blend is centrifuged to remove air entrained during mixing.

20. The single increment initiator charge of claim 17 wherein the homogenous blend is dried prior to compression to remove the solvent.

21. The single increment initiator charge of claim 15 wherein the oxidizer is selected from the group consisting of potassium perchlorate, potassium chlorate, potassium nitrate, aluminum oxide, magnesium nitrate, magnesium perchlorate, and combinations thereof.

22. The single increment initiator charge of claim 15 wherein the combustion enhancer is selected from the group consisting of metallic combustion enhancers, organic combustion enhancers, and combinations thereof.

23. The single increment initiator charge of claim 15 wherein the combustion enhancer comprises a metallic combustion enhancer selected from the group consisting of titanium hydride, aluminum, aluminum hydrides, copper, copper oxides, guanidine nitrate, magnesium, magnesium hydrides, titanium, zirconium, zirconium hydride, beryllium, and combinations thereof.

24. The single increment initiator charge of claim 15 wherein the combustion enhancer comprises an organic combustion enhancer including guanidine nitrate.

25. The single increment initiator charge of claim 15 wherein the homogeneous blend includes:

about 20 to about 60 composition weight percent of zirconium;

about 30 to about 75 composition weight percent of oxidizer; and about 10 to about 40 composition weight percent of combustion enhancer.

26. The single increment initiator charge of claim 25 wherein the homogeneous blend includes:

about 25 to about 35 composition weight percent of zirconium;

about 50 to about 60 composition weight percent of potassium perchlorate oxidizer; and about 10 to about 25 composition weight percent of titanium hydride combustion enhancer.

27. The single increment initiator charge of claim 15 wherein the homogeneous blend is compressed to a dry density of about 50 to about 95 percent of theoretical density.

28. The single increment initiator charge of claim 1 wherein the homogeneous blend is compressed to a dry density of about 50 to about 95 percent of theoretical density.

29. A method for making a single increment initiator charge for use in an inflator device for an inflatable restraint system, the method comprising:

preparing the homogeneous blend of claim 1;

loading the homogeneous blend into a charge holder; and compressing the homogeneous blend to form a single increment initiator charge.

30. The method of claim 29 wherein the zirconium, the oxidizer, and the combustion enhancer are dry-blended to form the homogeneous blend.

31. The method of claim 29 wherein the zirconium, the oxidizer and the combustion enhancer are mixed with a solvent to form the homogeneous blend.

32. The method of claim 31 further comprising the step of centrifuging the homogeneous blend to remove air entrained during mixing.

33. The method of claim 31 further comprising the step of drying the homogeneous blend to remove the solvent and form a dry homogeneous blend.

34. The method of claim 31 wherein the solvent includes an alcohol selected from the group consisting of isopropyl alcohol, n-propyl alcohol, and combinations thereof.

35. The method of claim 29 wherein the homogeneous blend includes at least about 20 composition weight percent of zirconium.

36. The method of claim 29 wherein the homogeneous blend includes at least about 25 composition weight percent of zirconium.

37. The method of claim 29 wherein the homogeneous blend includes at least about 30 composition weight percent of zirconium.

38. The method of claim 29 wherein the oxidizer comprises potassium perchlorate.

39. The method of claim 29 wherein combustion enhancer comprises titanium hydride.

40. The method of claim 29 wherein the homogeneous blend includes:

about 20 to about 60 composition weight percent of zirconium;

about 30 to about 75 composition weight percent of potassium perchlorate oxidizer; and about 10 to about 40 composition weight percent of titanium hydride combustion enhancer.

41. A The method of claim 29 wherein the homogeneous blend is compressed to a dry density of about 50 percent to about 95 percent of theoretical density.

* * * * *